US012409977B2

(12) United States Patent
Zhang

(10) Patent No.: US 12,409,977 B2
(45) Date of Patent: Sep. 9, 2025

(54) CHILDPROOF CONTAINING BAG

(71) Applicant: TedPack Company Limited, Dongguan (CN)

(72) Inventor: Man Zhang, Dongguan (CN)

(73) Assignee: TedPack Company Limited, Dongguan (CN)

( * ) Notice: Subject to any disclaimer, the term of this patent is extended or adjusted under 35 U.S.C. 154(b) by 156 days.

(21) Appl. No.: 18/451,041

(22) Filed: Aug. 16, 2023

(65) Prior Publication Data

US 2025/0019125 A1 Jan. 16, 2025

(30) Foreign Application Priority Data

Jul. 14, 2023 (CN) ..... 202310864867.0

(51) Int. Cl.
*B65D 33/25* (2006.01)

(52) U.S. Cl.
CPC ..... *B65D 33/25* (2013.01); *B65D 2215/06* (2013.01)

(58) Field of Classification Search
CPC ..... B65D 33/25; B65D 2215/06
USPC ..... 383/63, 9, 203
See application file for complete search history.

(56) References Cited

U.S. PATENT DOCUMENTS 5,100,000 A * 3/1992 Huseman ..... B65D 33/2508 383/65
10,005,592 B2 * 6/2018 Takigawa ..... B65D 33/2566
11,305,917 B2 * 4/2022 Aryanpanah ..... B65D 33/2566
11,718,456 B2 * 8/2023 Shen ..... B65D 33/2508 383/35
11,932,454 B2 * 3/2024 Aryanpanah ..... B65D 33/2558
2008/0226203 A1 * 9/2008 Dais ..... B65D 33/2541 383/63
2018/0118414 A1 * 5/2018 Martial ..... B65D 33/255
2021/0114777 A1 * 4/2021 Lee ..... B65D 33/2541
2023/0036651 A1 * 2/2023 Jiang ..... A44B 17/0058
2023/0150731 A1 * 5/2023 Plourde ..... B65B 69/0008 383/63

FOREIGN PATENT DOCUMENTS

CN 206580034 U * 10/2017
CN 207434097 U * 6/2018
CN 209441923 U * 9/2019
FR 3090593 A1 * 6/2020 ..... B65D 33/2508

OTHER PUBLICATIONS

Machine translation CN-206580034-U. (Year: 2017).*

* cited by examiner

*Primary Examiner* — Jes F Pascua

(57) ABSTRACT

A childproof containing bag is provided, which includes a main bag body, a first sealing strip, and a second sealing assembly. The first and second bag bodies are in an open state, and the first and second bag bodies are enclosed to form a containing space. The first sealing strip and the second sealing assembly are both arranged in the containing space. The second sealing strip and the first sealing strip are detachably sealed and connected. When the second sealing strip is sealed and connected to the first sealing strip, the sealing area between the second sealing strip and the first sealing strip separates the containing space into a first containing area and a second containing area. Children are unable to open the second and first sealing strips by pulling on the second bag body and the first bag body.

15 Claims, 8 Drawing Sheets

CHILDPROOF CONTAINING BAG

TECHNICAL FIELD

This application relates to the technical field of containing bags, in particular to the application of a childproof containing bag.

BACKGROUND

With the development of technology, containing bags are applied in people's daily lives to contain solid or powdery objects. The containing bags include a first bag body and a second bag body, which are connected to each other and contain objects through the connection of the first and second bag bodies. In existing technology, the first and second bag bodies are sealed by sealing strips, the first and second bag bodies in a sealed state to store objects, and the containing bag is placed in various places when storing objects, such as coffee tables, sofas, etc. In scenes with children, children sometimes may take the containing bag and pull on the first and second bag bodies through their hands, and the first and second bag bodies are easy to open under the pull of children's hands, causing the existing containing bag to be easily opened by children.

SUMMARY

The objective of the present application is to provide a childproof containing bag applied to solve the problems mentioned in the background.

To achieve the above objective, the present application provides the following technical solution:

A childproof containing bag, including:

a main bag body, comprising a first bag body and a second bag body connected to each other, wherein the first bag body and the second bag body are enclosed to form a containing space, and the containing space is provided with a first opening;

a first sealing strip connected to the first bag body, wherein the first sealing strip is located at an opposite position between the first bag body and the second bag body, and is arranged in the containing space;

a second sealing assembly connected to the second bag body and embedded in the containing space, wherein the second sealing assembly comprises a third bag body and a second sealing strip, the third bag body is located in the containing space, the third bag body is connected to the second bag body, the second sealing strip is connected to the third bag body and arranged corresponding to the first sealing strip, and the second sealing strip is detachably sealed and connected to the first sealing strip;

when the second sealing strip is sealed and connected to the first sealing strip, a sealing area between the second sealing strip and the first sealing strip separates the containing space into a first containing area and a second containing area; the first containing area is used to accommodate solid or powdery objects, and to seal and preserve the solid or powdery objects; the second containing area is used to accommodate hands of non child characters that extend through the first opening.

Optionally, the first bag body and the second bag body are in an open state, the third bag body is placed in the containing space, the second sealing strip detaches from the first sealing strip as the third bag body is moved; a top of the third bag body does not exceed a top of the second bag body or a top of the first bag body;

the third bag body is provided with a pulling part, wherein the pulling part is located on one side of the second sealing strip and faces the first opening of the containing space, and the pulling part is used for pulling the hands of the non child characters;

when the pulling part is pulled by the hands of the non child characters, the third bag body and the first bag body are moved in an opposite direction, and the second sealing strip detaches from the first sealing strip as the third bag body is moved.

Optionally, the second bag body and the first bag body are moved in the opposite direction when the second bag body is pulled by hands of children, and the second bag body and the third bag body gradually open, while the second sealing strip and the first sealing strip in the third bag body are still in a sealed connection.

Optionally, there is a safety distance between a top of the pulling part and the top of the second bag body, so that hands of children are unable to touch the pulling part; and the safety distance is greater than a distance grasped by thumbs of the children.

Optionally, a surface roughness of the pulling part is inconsistent with an inner surface roughness of the second bag body, and the surface roughness of the pulling part is greater than the inner surface roughness of the second bag body.

Optionally, the surface of the pulling part is provided with a friction layer, and the friction layer is configured for contact by the hands of the non child characters.

Optionally, the friction layer is provided with a plurality of arc-shaped bump regions, the plurality of the arc-shaped bump regions are arranged at intervals along a length direction of the friction layer, each of the plurality of the arc-shaped bump regions is provided with a plurality of bumps, and the plurality of bumps are arranged in concentric circles.

Optionally, the pulling part is provided with a gap, the gap is located in a middle of the pulling part and guides the hands of non child characters to pass through, so as to guide the hands of non child characters to contact the pulling part; and the gap is an arc-shaped groove or an irregular groove.

Optionally, an inner surface of the second bag body is provided with a second guide edge, the second guide edge extends along a length direction of the second bag body to a top of the pulling part and guides the hands of non child characters to contact the pulling part; an inner surface of the first bag body is provided with a first guide edge, the first guide edge extends along a length direction of the first bag body to the first sealing strip, and the first guide edge is arranged opposite to the second guide edge.

Optionally, the first sealing strip extends along a width direction of the first bag body; a first reinforcement strip is arranged between the first bag body and the first sealing strip, and the first reinforcement strip is arranged corresponding to the connection between the first bag body and the first sealing strip to reinforce the connection between the first bag body and the first sealing strip.

Optionally, the third bag body is movably connected to the second bag body, one end of the third bag body is connected to the second bag body, and the other end of the third bag body is detached from the second bag body, so that there is a motion space between the third bag body and the second bag body;

an inner surface of the second bag body is connected with a masking sheet, the masking sheet faces the other end of the third bag body; and the masking sheet is movably connected to the inner surface of the second bag body and shelters or detaches from the other end of the third bag body.

Optionally, one end of the masking sheet is connected to the inner surface of the second bag body, and an elastic member is connected between the masking sheet and the second bag body; two ends of the elastic member are respectively connected to the masking sheet and the second bag body, the elastic member applies elastic force to the masking sheet, and the masking sheet contacts with the other end of the third bag body under the elastic force of the elastic member, so that the third bag body is against the second bag body.

Optionally, a second reinforcement strip is arranged between the third bag body and the second bag body, the second reinforcement strip is arranged corresponding to the connection between the third bag body and the second bag body, to reinforce the connection between the third bag body and the second bag body.

Optionally, one of the first sealing strip and the second sealing strip is provided with a first snap part, the other is provided with a second snap part, and the first snap part is provided with an elliptical snap hook; the second snap part is provided with an elliptical snap groove; and the snap hook is located in the snap groove and mutually snapped when the second snap part and the first snap part are detachably snapped and connected;

the first snap part and the second snap part form a set of snap assembly; a plurality of the snap assemblies are arranged at intervals along a width direction of the third bag body, and the first snap part is alternately placed on the first sealing strip or the second sealing strip according to an arrangement of the plurality of the snap assemblies.

Optionally, the snap hook is provided with two oblique hooks arranged symmetrically, and the two oblique hooks respectively snap at both ends of the snap groove and engage at both ends of the snap groove.

Optionally, when the first snap part is in the first sealing strip and the second snap part is in the second sealing strip, the first snap part extends in a wavy manner along a length direction of the first sealing strip, and the second snap part extends in a wavy manner along a length direction of the second sealing strip.

Optionally, at least one of the first bag body, the second bag body, and the third bag body is made of degradable material.

Optionally, the first bag body, the second bag body, and the third bag body are all made of non degradable materials.

Optionally, the first bag body is connected to the second bag body; a connection between the first bag body and the second bag body is provided with a tear opening located on one side of the main bag body and near an end of the main bag body.

Optionally, the second bag body is provided with a positioning hole, the positioning hole is located at a top of the second bag body and above the third bag body; the positioning hole is a circular or irregular hole and configured for threading the positioning hook connected to the wall; when the positioning hook penetrates the positioning hole of the second bag body, the second bag body is connected to the positioning hook and suspended, and the main bag body is at a height that children are unable to reach.

Compared with the prior art, the advantageous effects of the present application are as following:

The present application provides a childproof containing bag, wherein the first and second bag bodies are enclosed to form a containing space, and both the first scaling strip and the second scaling assembly are arranged in the containing space; the second sealing assembly includes a third bag body and a second scaling strip, the third bag body is located in the containing space, and the third bag body is connected to the second bag body. The second sealing strip is connected to the third bag body and arranged corresponding to the first sealing strip, and the second scaling strip is detachably sealed and connected to the first sealing strip. When the second sealing strip is sealed and connected to the first sealing strip, the sealing area between the second sealing strip and the first sealing strip separates the containing space into a first containing area and a second containing area. The first containing area is used to accommodate solid or powdered objects, and seal and store solid or powdery objects, thereby achieving the sealing and storage function of a childproof containing bag, while the second containing area is used to accommodate the hands of adult that extends through the first opening. Wherein, since the first sealing strip and the second sealing assembly are both arranged in the containing space, not exposed to the first and second bag bodies, so as to prevent children from opening the third and second bag bodies when they see the bag. It is necessary to pull on the third and first bag bodies to open the second and first sealing strips, children cannot open the second and first sealing strips when pulling on the second and first bag bodies, such that the sealing and storage function of the childproof containing bag is ensured, preventing children from opening the childproof containing bag.

BRIEF DESCRIPTION OF THE DRAWINGS

In order to provide a clearer illustration of the technical solution in the embodiments of this application, a brief introduction will be given below to the accompanying drawings required in the description of the embodiments. It is apparent that the accompanying drawings in the following description are only some embodiments of the present application. For those skilled in the art, other accompanying drawings can be obtained based on these drawings without any creative labor.

In order to provide a more complete understanding of this application and its advantageous effects, the following will be illustrated in conjunction with the accompanying drawings. In the following description, the same reference numerals refer to the same parts.

REFERENCE NUMERALS IN THE ATTACHED DRAWINGS

Figure 1:
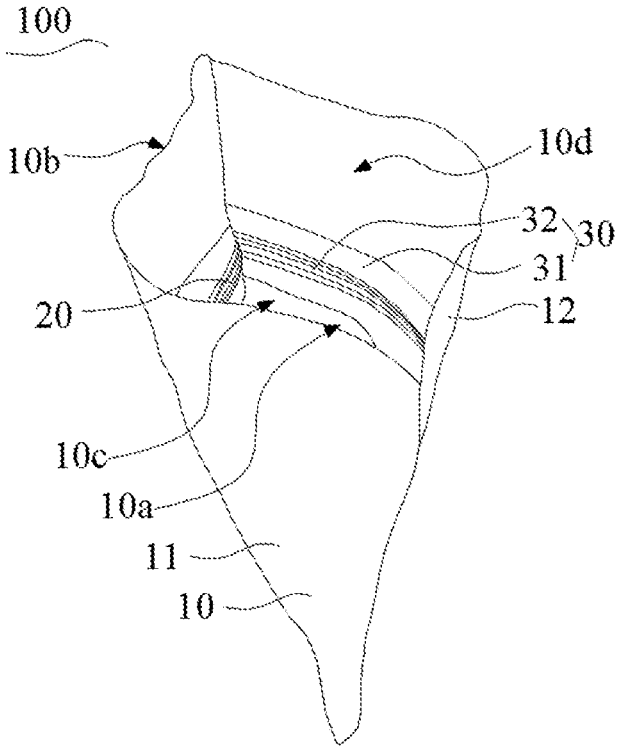
FIG. 1 is a schematic diagram showing of the open state of a childproof containing bag provided in the first embodiment of the present application.
Figure 2:
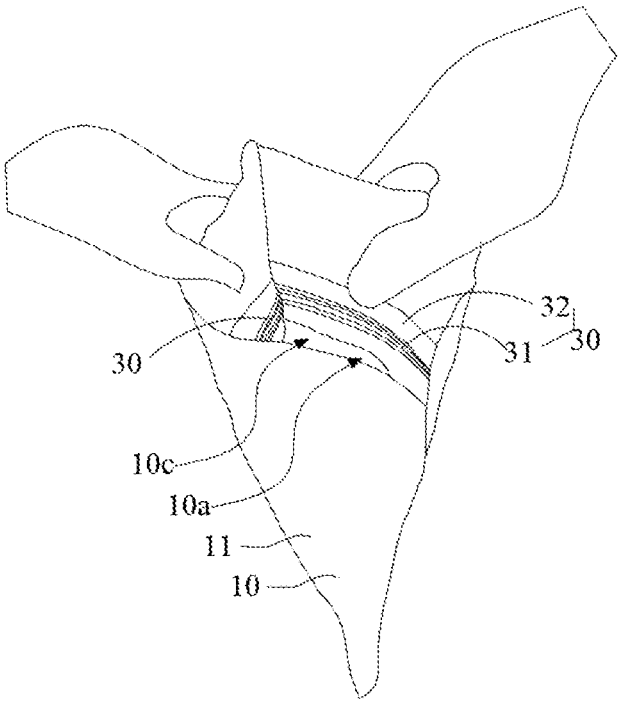
FIG. 2 is a schematic diagram shown that the childproof containing bag in the first embodiment of the present application is opened by hands of an adult.
Figure 3:
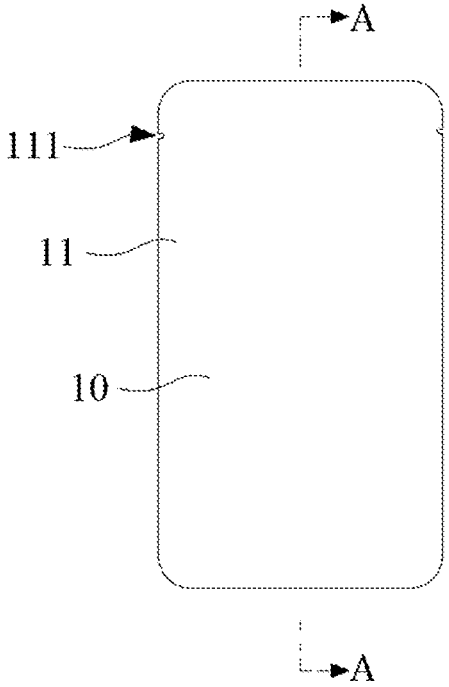
FIG. 3 is a front view showing of the childproof containing bag provided in the first embodiment of the present application.
Figure 4:
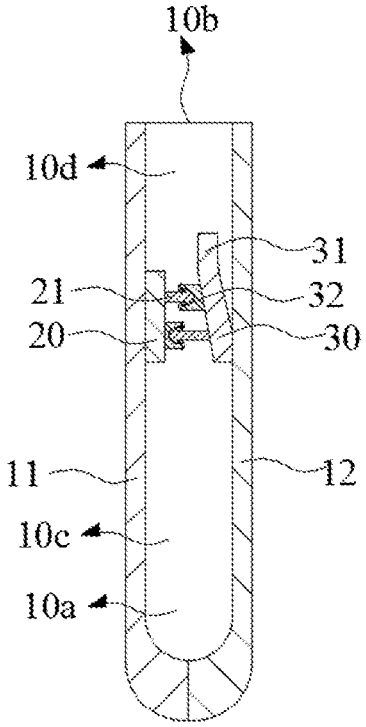
FIG. 4 is a cross-sectional view of the FIG. 3 which is taken along the section A.
Figure 5:
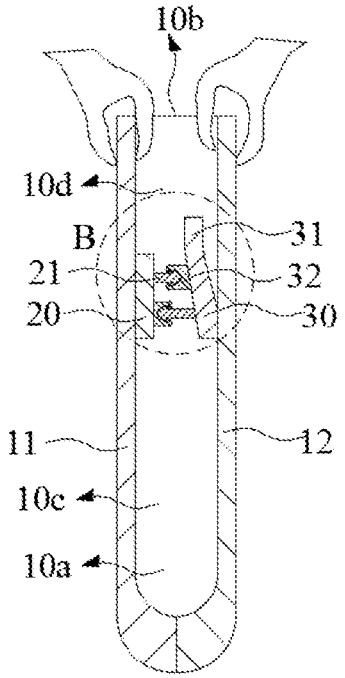
FIG. 5 is a schematic diagram shown that a child tries to open the childproof containing bag provided in the first embodiment of the present application.
Figure 6:
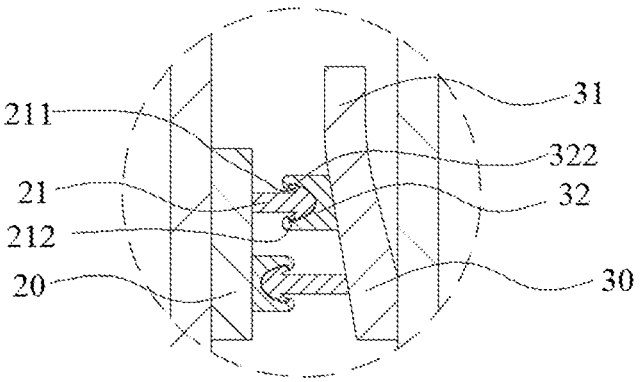
FIG. 6 is an enlarged partial view of the part B in FIG. 5.

100—childproof containing bag. 200—wall, 210—positioning hook;

10—main bag body, 10*a*—containing space, 10*b*—the first opening, 10*c*—the first containing area, 10*d*—the second containing area, 11—the first bag body, 111—tear opening, 112—the first guide edge, 113—the first reinforcement strip, 12—the second bag body, 121—the second guide edge, 122—the second reinforcement strip, 123—masking sheet, 124—elastic member, 125—positioning hole;

20—the first sealing strip, 21—the first snap part, 211—snap hook, 212—oblique hook;

30—the second sealing assembly, 31—the third bag body, 311—pulling part, 312—friction layer, 3121—arc-shaped bump region, 3122—bump, 313—gap, 32—the second sealing strip, 321—the second snap part, 322—snap groove.

DETAILED DESCRIPTION OF THE EMBODIMENTS

The following will provide a clear and complete description of the technical solution in the embodiments of the present application in conjunction with the accompanying drawings. It is apparent that the described embodiments are only a part of the embodiments of this application, not all of them. Based on the embodiments in this application, all other embodiments obtained by those skilled in the art without creative labor fall within the scope in this application.

Embodiment 1

Please refer to FIG. 1 to FIG. 6, the embodiments of this application provide a childproof containing bag 100, which is suitable for use in daily life and can accommodate solid or powdered objects while preventing children from opening. In this case, the childproof containing bag 100 includes a main bag body 10, a first sealing strip 20, and a second sealing assembly 30, and the first sealing strip 20 and the second sealing assembly 30 are respectively connected to the main bag body 10.

The main bag body 10 serves as the main part of the childproof containing bag 100. The main bag body 10 includes a first bag body 11 and a second bag body 12 which are connected to each other. In the present embodiment, the edge of the first bag body 11 and the edge of the second bag body 12 are connected by hot pressing.

The first bag body 11 and the second bag body 12 are in an open state, and the first bag body 11 and the second bag body 12 are enclosed to form a containing space 10*a*. The containing space 10*a* has a first opening 10*b*, when the childproof containing bag 100 is in a vertical direction, the first opening 10*b* is at the top of the main bag body 10.

The first sealing strip 20 is connected to the first bag body 11, and the first sealing strip 20 is located at the opposite position between the first bag body 11 and the second bag body 12 and is arranged in the containing space 10*a*. In the present embodiment, the first sealing strip 20 is located within the containing space 10*a*, and the first sealing strip 20 extends along the width direction of the first bag body 11. The first sealing strip 20 is located above the middle of the second bag body 12.

The second sealing assembly 30 is connected to the second bag body 12 and is arranged in the containing space 10*a*. In the present embodiment, the first sealing strip 20 and the second sealing assembly 30 are both arranged in the containing space 10*a*, and are arranged corresponding to the first bag body 11 and the second bag body 12 to avoid exposure to the external environment and direct contact with children.

Wherein, the second sealing assembly 30 includes a third bag body 31 and a second sealing strip 32, the third bag body 31 is located in the containing space 10*a*, and the third bag body 31 is connected to the second bag body 12. The second sealing strip 32 is connected to the third bag body 31 and arranged corresponding to the first sealing strip 20. The second sealing strip 32 is detachably sealed with the first sealing strip 20, or the second sealing strip 32 detaches from the first sealing strip 20 as the third bag body 31 is moved.

When the second sealing strip 32 is sealed and connected to the first sealing strip 20, a sealing area between the second sealing strip 32 and the first sealing strip 20 separates the containing space 10*a* into a first containing area 10*c* and a second containing area 10*d*. The first containing area 10*c* is used to accommodate solid or powdery objects, and to seal and preserve the solid or powdery objects, while the second containing area 10*d* is used to accommodate hands of non child characters that extend through the first opening.

Wherein, since the first sealing strip 20 and the second sealing assembly 30 are both arranged in the containing space 10*a* and not exposed to the first bag body 11 and the second bag body 12, children are prevented from opening the third bag body 31 and the second bag body 12 when they see the childproof containing bag 100. At the same time, it is necessary to pull the third bag body 31 and the first bag body 11 to open the second sealing strip 32 and the first scaling strip 20, thus children are unable to open the second sealing strip 32 and the first sealing strip 20 while pulling on the second bag body 12 and the first bag body 11, so as to ensure the sealing and storage function of the childproof containing bag 100 and to prevent children from opening the childproof containing bag 100.

Therefore, the sealing connection between the first sealing strip 20 and the second sealing strip 32 separates the containing space 10*a*, and divides the containing space 10*a* into the first containing area 10*c* and the second containing area 10*d*. The first containing area 10*c* is used to accommodate solid or powder objects, and to seal and store the solid or powder objects. The distinction between the first containing area 10*c* and the second containing area 10*d* ensures the sealing effect of the first containing area 10*c* on solid or powdery objects, avoiding the separation of solid or powdery objects from the first containing area 10*c*, while the second containing area 10*d* is used to accommodate the hands of non children's characters pass through the first opening, and to restrict the hands of non children's characters, thereby avoiding children's hands from contacting the third bag body 31. Thus, children's hands are restricted from simultaneously pulling on the third bag body 31 and the first bag body 11, in order to prevent children from opening the childproof containing bag 100.

In the present embodiment, the third bag body 31 is arranged in the containing space 10*a*, and the top of the third bag body 31 does not exceed the top of the second bag body 12 or the top of the first bag body 11, so that the third bag body 31 is hidden between the second bag body 12 and the first bag body 11, and is out of reach of children's hands, further preventing children from opening the childproof containing bag 100 and improving the functional effect of the childproof containing bag 100.

In addition, the third bag body 31 is movably connected to the second bag body 12, one end of the third bag body 31 is connected to the second bag body 12, and the other end is detached from the second bag body 12. In the present embodiment, one end of the third bag body 31 is hot pressed onto the surface of the second bag body 12, and the other end of the third bag body 31 is not connected to the surface of the second bag body 12, and there is a motion space between the third bag body 31 and the second bag body 12. Thus, the motion space facilitates the movement of the third bag body 31 relative to the second bag body 12, and affects the sealing connection between the third bag body 31 and the first bag body 11 when pulling the second bag body 12. This ensures that children cannot open the second sealing strip 32 and the first sealing strip 20 when pulling the second bag body 12 and the first bag body 11, thereby ensuring the sealing function of the first containing area 10*c* for solid or powder objects. Optionally, solid or powdered objects may be medicinal powder, and there are no restrictions here.

In addition, one of the first sealing strip 20 and the second sealing strip 32 is provided with a first snap part 21, and the other is provided with a second snap part 321. Optionally, the first scaling strip 20 is provided with a first snap part 21, and the second sealing strip 32 is provided with a second snap part 321, which is not limited here.

The first snap part 21 is provided with an elliptical snap hook 211, and the second snap part 321 is provided with an elliptical snap groove 322. The snap hook 211 is located in the snap groove 322 and mutually snapped when the second snap part 321 and the first snap part 21 are detachably snapped and connected, so as to facilitate the detachable sealing connection between the first sealing strip 20 and the second sealing strip 32 through the snap connection between the first snap part 21 and the second snap part 321.

In the present embodiment, the first snap part 21 and the second snap part 321 form a set of snap assembly. A plurality of the snap assemblies are arranged at intervals along the width direction of the third bag body 31, and the first snap part 21 is alternately placed on the first scaling strip 20 or the second sealing strip 32 according to an arrangement of the plurality of the snap assemblies. Thus, the alternating arrangement of the first snap part 21 and the second snap part 321 improves the overall effect of the first sealing strip 20 and the second sealing strip 32, ensuring the sealing effect of the first sealing strip 20 and the second sealing strip 32. Optionally, the snap hook 211 is provided with two oblique hooks 212 arranged symmetrically, and the two oblique hooks 212 respectively snap at both ends of the snap groove 322 and engage at both ends of the snap groove 322, thereby achieving a snap connection between the first snap part 21 and the second snap part 321 through the engagement of the two oblique hooks 212 at the snap groove 322.

Optionally, when the first snap part 21 is in the first sealing strip 20 and the second snap part 321 is in the second sealing strip 32, the first snap part 21 extends in a wavy manner along the length direction of the first sealing strip 20, and the second snap part 321 extends in a wavy manner along the length direction of the second sealing strip 32. The first snap part 21 matches with the second snap part 321.

In addition, at least one of the first bag body 11, the second bag body 12 and the third bag body 31 is made of degradable materials. In the present embodiment, the degradable materials may be polylactic acid material, butylene adipate-co-butylene terephthalate material, polybutylenes succinate material, polypropylene carbonate material, aliphatic copolyester material or polyglycolic acid material, which are not limited here. Alternatively, the first bag body 11, the second bag body 12, and the third bag body 31 are all made of non degradable materials, in this case, the non degradable material may be PET film material or polyethylene material, and there is no restriction here.

In addition, there is a tear opening 111 at the connection between the first bag body 11 and the second bag body 12. The tear opening 111 is located to one side of the main bag body 10 and is close to the end slot of the main bag body 10. In the present embodiment, the tear opening 111 is used for the hands of non child characters to tear the bag, so as to reduce the distance between the top of the second bag body 12 and the top of the third bag body 31 after tearing, thereby facilitating the hands of non child characters to contact the third bag body 31. Thus, it facilitates the hands of non child characters to pull the third bag body 31 and the first bag body 11.

Embodiment 2

Figure 7:
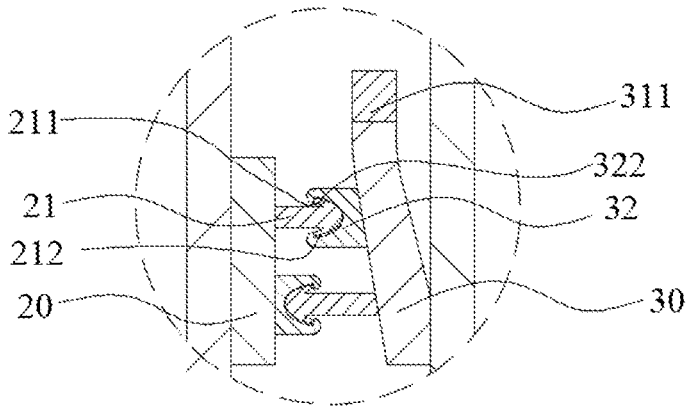
FIG. 7 is a schematic diagram of the pulling part of the childproof containing bag provided in the second embodiment of the present application.
Figure 8:
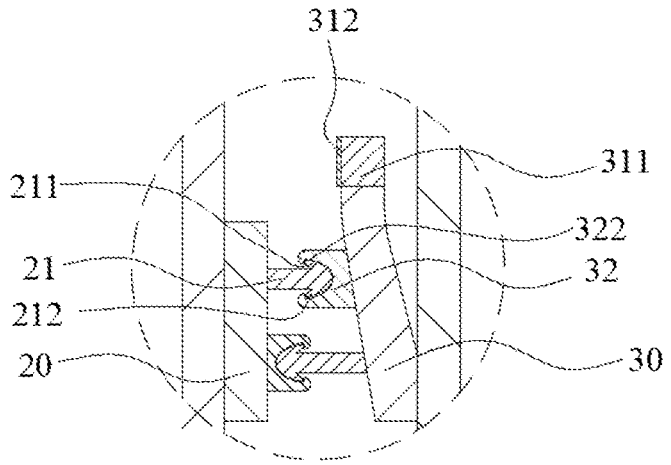
FIG. 8 is a schematic diagram of the friction layer of the childproof containing bag provided in the third embodiment of the present application.
Figure 9:
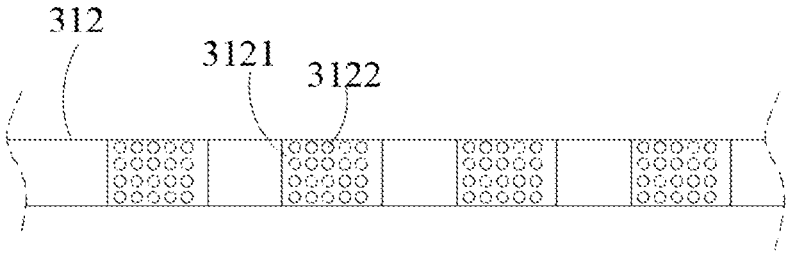
FIG. 9 is a schematic diagram of the arc-shaped bump region of the childproof containing bag provided in the third embodiment of the present application.
Figure 10:
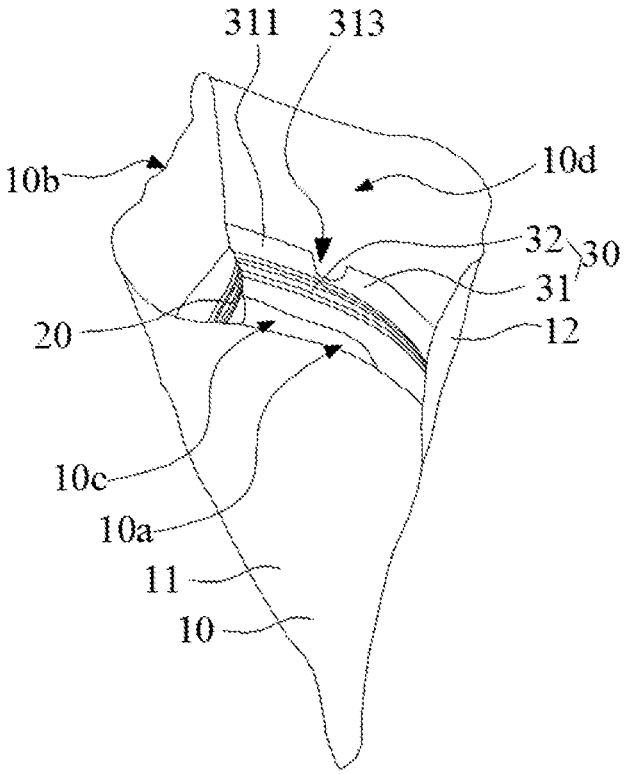
FIG. 10 is a schematic diagram of the gap in the childproof containing bag provided in the third embodiment of this application.
Figure 11:
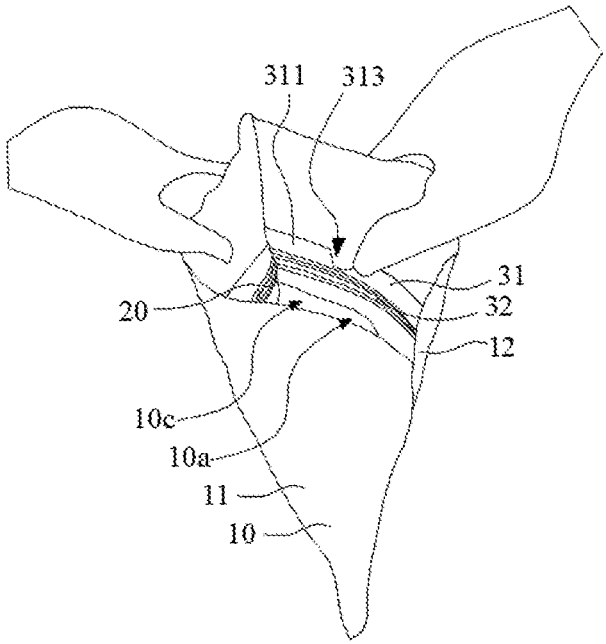
FIG. 11 is a schematic diagram of the gap provided in the third embodiment of the present application when the childproof containing bag is used by an adult.

Please refer to FIG. 7, compared to the first embodiment, the third bag body 31 is provided with a pulling part 311. The pulling part 311 is located on one side of the second sealing strip 32 and faces the first opening 10*b* of the containing space 10*a*. In the present embodiment, the third bag body 31 is far away from the connection between the third bag body 31 and the second bag body 12. The pulling part 311 is used for pulling the hands of non children characters, as children's hands cannot contact the third bag body 31, as a result, it is impossible to contact the pulling part 311 of the third bag body 31, avoiding children from pulling on the third bag body 31 and the second bag body 12. Optional, non child characters may be adults, middle-aged people, or elderly people.

When the pulling part 311 is pulled by the hands of non child characters, both the pulling part 311 and the first bag body 11 are subjected to the pulling force of the hands of non child characters, and the third bag body 31 and the first bag body 11 move in the opposite direction. The distance between the third bag body 31 and the first bag body 11 gradually increases, and the second sealing strip 32 detaches from the first sealing strip 20 with the movement of the third bag body 31.

Alternatively, when the second bag body 12 is pulled by the hands of a child, both the second bag body 12 and the first bag body 11 are subjected to the pulling force of the hands of a non child. The second bag body 12 and the first bag body 11 move in the opposite direction, the second bag body 12 and the third bag body 31 gradually open, and the distance between the third bag body 31 and the first bag body 11 remains unchanged, while the second sealing strip 32 and the first sealing strip 20 located in the third bag body 31 still form a sealed connection. Thus, the pulling between the second bag body 12 and the first bag body 11 will not affect the distance between the third bag body 31 and the first bag body 11, and the sealing connection between the second sealing strip 32 and the first sealing strip 20 will not be affected by the pulling between the second bag body 12 and the first bag body 11, ensuring the sealing performance of the first containing area 10*c* to solid or powder objects.

Optionally, there is a safety distance between the top of the pulling part 311 and the top of the second bag body 12, so that children's hands cannot touch the pulling part 311. The safety distance is greater than the distance grasped by the children's thumb. In this case, the safety distance may be greater than 20 centimeters, and the safety distance can be adjusted according to the actual situation.

Embodiment 3

Please refer to FIG. 8 to FIG. 11, compared to the second embodiment, the surface roughness of the pulling part 311 is inconsistent with the roughness of the inner surface of the second bag body 12. Wherein the surface roughness of the pulling part 311 is greater than the roughness of the inner surface of the second bag body 12. In the present embodiment, the surface roughness of the pulling part 311 is inconsistent with the roughness of the inner surface of the second bag body 12, which facilitates the hand feel recognition of non children's characters. Because the pulling part 311 is provided in the containing space 10*a* and is hidden between the second bag body 12 and the first bag body 11, it is easy to identify the pulling part 311 and the second bag body 12 through the hand feel of non children's characters, making it easy for the hands of non children's characters to find the pulling part 311, so that the hands of non children's characters can act on the pulling part 311 and the second bag body 12, thereby improving the operational convenience of the childproof containing bag 100.

In addition, the surface of the pulling part 311 is provided with a friction layer 312, and the friction layer 312 is configured for contact by the hands of the non child characters. Optionally, the friction layer 312 is a friction plate that attaches to the surface of the pulling part 311. Wherein, the friction layer 312 is provided with a plurality of arc-shaped bump regions 3121, the plurality of the arc-shaped bump regions 3121 are arranged at intervals along the length direction of the friction layer 312. Each of the plurality of the arc-shaped bump regions 3121 is provided with a plurality of bumps 3122, and the plurality of bumps 3122 are arranged in concentric circles. In the present embodiment, one arc-shaped bump regions 3121 is formed by the plurality of bumps 3122, and based on the contact between the plurality of bumps 3122 and the hands of non children's characters, the tactile sensation of the pulling part 311 is improved, thereby facilitating the hands of non children's characters to find the pulling part 311, and thus facilitating the operation of the pulling part 311 by the hands of non children's characters.

Optionally, the pulling part 311 is provided with a gap 313, the gap 313 is located in the middle of the pulling part 311, in the present embodiment, the hands of non children's characters enter the second containing area 10*d*, and the pulling part 311 can be found when touching the gap 313, such that it is easier for the hands of non children's characters to find the pulling part 311, so as to facilitate the use of the pulling part 311 and the second bag body 12 by the hands of non children's characters, improving the operational convenience of the childproof containing bag 100. In the present embodiment, the gap 313 of the pulling part 311 guides the hands of non child characters to pass through, so as to guide the hands of non child characters to contact the pulling part. Optionally, the gap 313 is an arc-shaped groove or an irregular groove.

Embodiment 4

Figure 12:
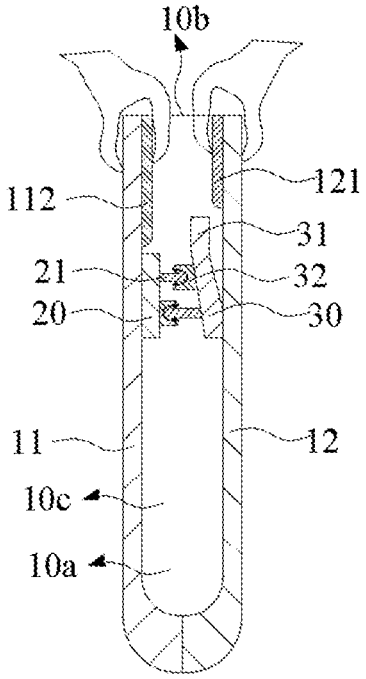
FIG. 12 is a schematic diagram of the second edge and the first guide edge of the childproof containing bag provided in the fourth embodiment of the present application.

Please refer to FIG. 12, compared to the second embodiment, the inner surface of the second bag body 12 is provided with a second guide edge 121. The second guide edge 121 extends along the length direction of the second bag body 12 to the top of the pulling part 311 and guides the hands of non child characters to contact the pulling part 311. At this point, the second guide edge 121 can be a straight strap protruding on the inner surface of the second bag body 12, guiding the hands of non children characters through the second guide edge 121, in order to facilitate the hands of non children characters to find the pulling part 311 along the second guide edge 121.

Optionally, the inner surface of the first bag body 11 is provided with a first guide edge 112, which extends along the length direction of the first bag body 11 to the first sealing strip 20. The first guide edge 112 is arranged opposite to the second guide edge. At this point, the first guide edge 112 can be a straight strap protruding from the inner surface of the first bag body 11. By guiding the hands of non children characters through the first guide edge 112, the position of the second guide edge 121 can be determined for the hands of non children characters, so that the hands of non children characters can find the pulling part 311 through the guidance of the second guide edge 121.

Embodiment 5

Figure 13:
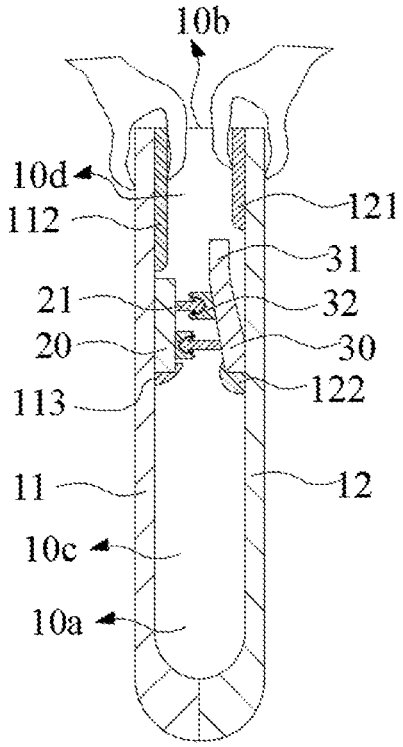
FIG. 13 is a schematic diagram of the second reinforcement strip and the first reinforcement strip of the childproof containing bag provided in the fifth embodiment of the present application.

Please refer to FIG. 13, compared to the first embodiment, there is a first reinforcement strip 113 between the first bag body 11 and the first sealing strip 20. The first reinforcement strip 113 is arranged corresponding to the connection between the first bag body 11 and the first sealing strip 20, so as to reinforce the connection between the first bag body 11 and the first sealing strip 20 to increase the service life of the connection between the first bag body 11 and the first scaling strip 20 through the first reinforcement strip 113 and avoid damage due to frequent pulling.

In addition, there is a second reinforcement strip 122 between the third bag body 31 and the second bag body 12. The second reinforcement strip 122 is arranged corresponding to the connection between the third bag body 31 and the second bag body 12, so as to reinforce the connection between the third bag body 31 and the second bag body 12 to increase the service life of the connection between the third bag body 31 and the second sealing strip 32 through the second reinforcement strip 122 and avoid damage due to frequent pulling.

Embodiment 6

Figure 14:
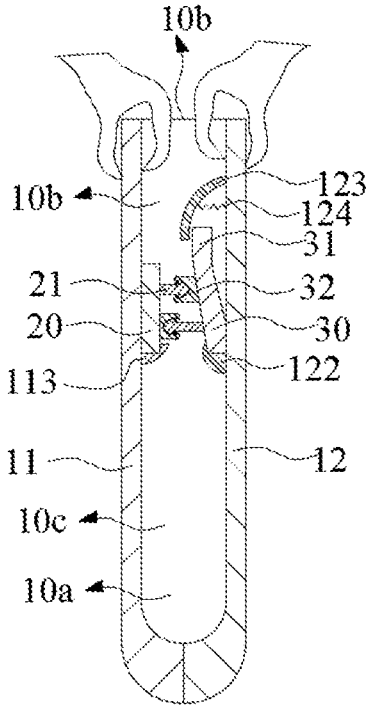
FIG. 14 is a schematic diagram of a masking sheet of the childproof containing bag provided in the sixth embodiment of the present application.

Please refer to FIG. 14, compared to the first embodiment, the inner surface of the second bag body 12 is connected with a masking sheet 123, and the masking sheet 123 faces the other end of the third bag body 31. The masking sheet 123 is movably connected to the inner surface of the second bag body 12 and shelters from the other end of the third bag body 31 or detaches from the other end of the third bag body 31. In the present embodiment, when the masking sheet 123 shelters the other end of the third bag body 31, the third bag body 31 is in a hidden state to avoid contact with children's hands. When the third bag body 31 needs to be pulled, the hands of non children's characters flip the masking sheet 123 to show the third bag body 31 to facilitate the third bag body 31 being pulled by the hands of non children's characters, thereby the hands of non children's characters pull the third bag body 31 and the first bag body 11 to further unseal the sealing state of the second sealing strip 32 and the first sealing strip 20, in order to facilitate the removal of solid or powder objects in the first containing area 10*c*.

In addition, one end of the masking sheet 123 is connected to the inner surface of the second bag body 12, and an elastic member 124 is connected between the masking sheet 123 and the second bag body 12. The two ends of the elastic member 124 are respectively connected to the masking sheet 123 and the second bag body 12, the elastic member applies elastic force to the masking sheet 123, and the masking sheet 123 contacts with the other end of the third bag body 31 under the elastic force of the elastic member 124, so that the third bag body 31 is against the second bag body 12, to facilitate the continuous contact of the masking sheet 123 to the third bag body 31 under the elastic action of the elastic member 124, ensuring the concealed effect of the masking sheet 123 on the third bag body 31. Optionally, the elastic member 124 is a leaf spring.

Embodiment 7

Figure 15:
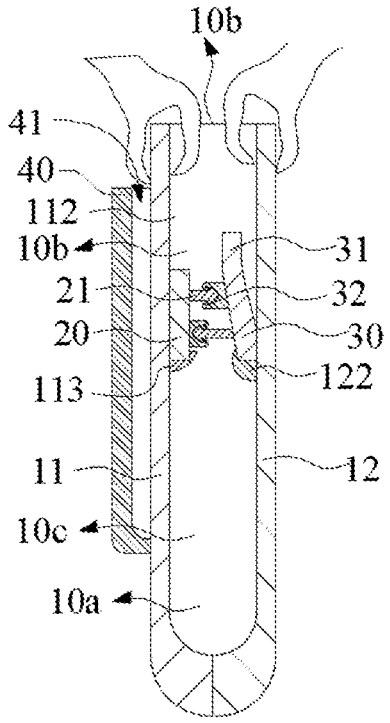
FIG. 15 is a schematic diagram of the fourth bag body of the childproof containing bag provided in the seventh embodiment of the present application.
Figure 16:
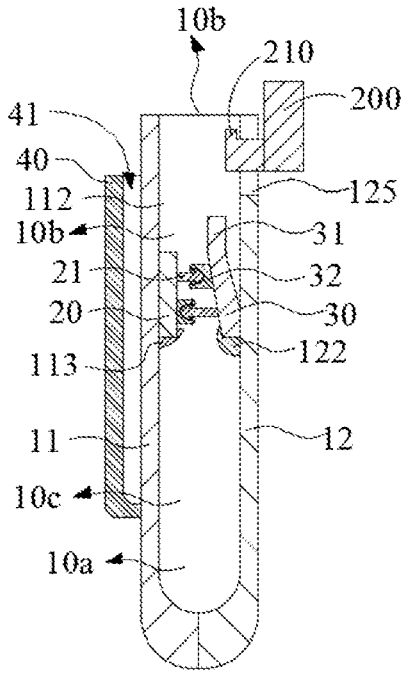
FIG. 16 is a schematic diagram of the hook of the childproof containing bag provided in the seventh embodiment of this application.

Please refer to FIG. 15 and FIG. 16, compared to the first embodiment, the surface of the first bag body 11 facing away from the second bag body 12 is connected with a fourth bag body 40. The fourth bag body 40 is exposed to the first bag body 11, and the fourth bag body 40 is provided with a holding groove 41 for accommodating objects. At this time, the fourth bag body 40 is added to the first bag body 11, and the holding groove 41 is added to improve the holding effect of the childproof containing bag 100.

In addition, the second bag body 12 is provided with a positioning hole 125, which is located at the top of the second bag body 12 and above the third bag body 31. The positioning hole 125 is a circular or irregular hole, and is used for threading the positioning hook 210 connected to the wall 200. When the positioning hook 210 penetrates through the positioning hole 125 of the second bag body 12, the second bag body 12 is connected to the positioning hook 210 and suspended in the air, and the main bag body 10 is at a height that children cannot reach, thereby ensuring that the main bag body 10 is in a suspended state to avoid children's contact, and ensuring that the childproof containing bag 100 has high safety due to being inaccessible to children.

In the above embodiments, the descriptions of each embodiment have their own emphasis. For the parts that are not detailed in one embodiment, please refer to the relevant descriptions of other embodiments.

In the description of this application, the terms "first" and "second" are only used for descriptive purposes and cannot be understood as indicating or implying relative importance or implying the quantity of indicated technical features. Therefore, features limited to "first" and "second" can explicitly or implicitly include one or more features.

This application applies specific embodiments to explain the principles and implementation methods of this application. The above embodiments are only used to help understand the methods and ideas of this application. Meanwhile, for skilled person in the art, there may be changes in the specific implementation methods and application scope based on the ideas of this application. In summary, the content of this specification should not be understood as a limitation on this application.

What is claimed is:

1. A childproof containing bag, comprising:

a main bag body, comprising a first bag body and a second bag body connected to each other, wherein the first bag body and the second bag body are enclosed to form a containing space, and the containing space is provided with a first opening;

a first sealing strip connected to the first bag body, wherein the first sealing strip is located at an opposite position between the first bag body and the second bag body, and is arranged in the containing space;

a first sealing assembly connected to the second bag body and embedded in the containing space, wherein the first sealing assembly comprises a third bag body and a second sealing strip, the third bag body is located in the containing space, the third bag body is connected to the second bag body, the second sealing strip is connected to the third bag body and arranged corresponding to the first sealing strip, and the second sealing strip is detachably sealed and connected to the first sealing strip;

when the second sealing strip is sealed and connected to the first sealing strip, a sealing area between the second sealing strip and the first sealing strip separates the containing space into a first containing area and a second containing area; the first containing area is used to accommodate solid or powdery objects, and to seal and preserve the solid or powdery objects; the second containing area is used to accommodate hands of non child characters that extend through the first opening;

the first bag body and the second bag body are in an open state, the third bag body is placed in the containing space, the second sealing strip detaches from the first sealing strip as the third bag body is moved; a top of the third bag body does not exceed a top of the second bag body or a top of the first bag body;

the third bag body is provided with a pulling part, wherein the pulling part is located on one side of the second sealing strip and faces the first opening of the containing space, and the pulling part is used for pulling the hands of the non child characters;

when the pulling part is pulled by the hands of the non child characters, the third bag body and the first bag body are moved in an opposite direction, and the second sealing strip detaches from the first sealing strip as the third bag body is moved;

the surface of the pulling part is provided with a friction layer, and the friction layer is configured for contact by the hands of the non child characters;

the friction layer is provided with a plurality of arc-shaped bump regions, the plurality of the arc-shaped bump regions are arranged at intervals along a length direction of the friction layer, each of the plurality of the arc-shaped bump regions is provided with a plurality of bumps, and the plurality of bumps are arranged in concentric circles.

2. The childproof containing bag according to claim 1, wherein the second bag body and the first bag body are moved in the opposite direction when the second bag body is pulled by hands of children, and the second bag body and the third bag body gradually open, while the second sealing strip and the first sealing strip in the third bag body are still in a sealed connection.

3. The childproof containing bag according to claim 1, wherein a surface roughness of the pulling part is inconsistent with an inner surface roughness of the second bag body, and the surface roughness of the pulling part is greater than the inner surface roughness of the second bag body.

4. The childproof containing bag according to claim 1, wherein the pulling part is provided with a gap, the gap is located in a middle of the pulling part and guides the hands of non child characters to pass through, so as to guide the hands of non child characters to contact the pulling part.

5. The childproof containing bag according to claim 1, wherein an inner surface of the second bag body is provided with a second guide edge, the second guide edge extends along a length direction of the second bag body to a top of the pulling part and guides the hands of non child characters to contact the pulling part; an inner surface of the first bag body is provided with a first guide edge, the first guide edge extends along a length direction of the first bag body to the first sealing strip, and the first guide edge is arranged opposite to the second guide edge.

6. The childproof containing bag according to claim 1, wherein the first sealing strip extends along a width direction of the first bag body; a first reinforcement strip is arranged between the first bag body and the first sealing strip, and the first reinforcement strip is arranged corresponding to the connection between the first bag body and the first sealing strip to reinforce the connection between the first bag body and the first sealing strip.

7. The childproof containing bag according to claim 6, wherein a second reinforcement strip is arranged between the third bag body and the second bag body, the second reinforcement strip is arranged corresponding to the connection between the third bag body and the second bag body, to reinforce the connection between the third bag body and the second bag body.

8. The childproof containing bag according to claim 1, wherein the third bag body is movably connected to the second bag body, one end of the third bag body is connected to the second bag body, and the other end of the third bag body is detached from the second bag body, so that there is a motion space between the third bag body and the second bag body;

an inner surface of the second bag body is connected with a masking sheet, the masking sheet faces the other end of the third bag body; and the masking sheet is movably connected to the inner surface of the second bag body and shelters or detaches from the other end of the third bag body.

9. The childproof containing bag according to claim 8, wherein one end of the masking sheet is connected to the inner surface of the second bag body, and an elastic member is connected between the masking sheet and the second bag body; two ends of the elastic member are respectively connected to the masking sheet and the second bag body, the elastic member applies elastic force to the masking sheet, and the masking sheet contacts with the other end of the third bag body under the elastic force of the elastic member, so that the third bag body is against the second bag body.

10. The childproof containing bag according to claim 1, wherein one of the first sealing strip and the second sealing strip is provided with a first snap part, the other is provided with a second snap part, and the first snap part is provided with an elliptical snap hook; the second snap part is provided with an elliptical snap groove; and the snap hook is located in the snap groove and mutually snapped when the second snap part and the first snap part are detachably snapped and connected;

the first snap part and the second snap part form a set of snap assembly; a plurality of the snap assemblies are arranged at intervals along a width direction of the third bag body, and the first snap part is alternately placed on the first sealing strip or the second sealing strip according to an arrangement of the plurality of the snap assemblies.

11. The childproof containing bag according to claim 10, wherein the snap hook is provided with two oblique hooks arranged symmetrically, and the two oblique hooks respectively snap at both ends of the snap groove and engage at both ends of the snap groove.

12. The childproof containing bag according to claim 1, wherein at least one of the first bag body, the second bag body, and the third bag body is made of degradable material.

13. The childproof containing bag according to claim 1, wherein the first bag body, the second bag body, and the third bag body are all made of non degradable materials.

14. The childproof containing bag according to claim 1, wherein the first bag body is connected to the second bag body; a connection between the first bag body and the second bag body is provided with a tear opening located on one side of the main bag body and near an end of the main bag body.

15. The childproof containing bag according to claim 1, wherein the second bag body is provided with a positioning hole, the positioning hole is located at a top of the second bag body and above the third bag body; the positioning hole is configured for threading the positioning hook connected to a wall; when the positioning hook penetrates the positioning hole of the second bag body, the second bag body is connected to the positioning hook and suspended, and the main bag body is at a height that children are unable to reach.

* * * * *